US011994011B2

(12) United States Patent
Wang et al.

(10) Patent No.: US 11,994,011 B2
(45) Date of Patent: May 28, 2024

(54) PERMANENT PACKER AND EXTENDED GAS LIFT METHOD USING PERMANENT PACKER

(71) Applicants: PetroChina Company Limited, Beijing (CN); Sichuan Shengnuo Oil. And Gas Engineering Technology Service Co. Ltd, Deyang (CN)

(72) Inventors: Weilin Wang, Beijing (CN); Huiyun Ma, Beijing (CN); Changqing Ye, Beijing (CN); Hao Tan, Beijing (CN); Hanbing Tang, Beijing (CN); Daogang Cai, Beijing (CN); Xueqiang Wang, Beijing (CN); Yukui Hong, Beijing (CN); Fengjing Sun, Beijing (CN); Wei Zhou, Beijing (CN); Ting Zhang, Beijing (CN); Zonghao Dong, Beijing (CN); Yan Huang, Beijing (CN); Yun Miao, Beijing (CN)

(73) Assignees: PetroChina Company Limited, Beijing (CN); Sichuan Shengnuo Oil. and Gas Engineering Technology Service Co. Ltd, Deyang (CN)

( * ) Notice: Subject to any disclaimer, the term of this patent is extended or adjusted under 35 U.S.C. 154(b) by 176 days.

(21) Appl. No.: 17/761,018

(22) PCT Filed: Sep. 16, 2020

(86) PCT No.: PCT/CN2020/115564
§ 371 (c)(1),
(2) Date: Mar. 16, 2022

(87) PCT Pub. No.: WO2021/052360
PCT Pub. Date: Mar. 25, 2021

(65) Prior Publication Data

US 2022/0349282 A1 Nov. 3, 2022

(30) Foreign Application Priority Data

Sep. 16, 2019 (CN) ..... 201910871364.X
Sep. 16, 2019 (CN) ..... 201910871370.5

(51) Int. Cl.
*E21B 43/12* (2006.01)
*E21B 33/12* (2006.01)
*E21B 33/129* (2006.01)

(52) U.S. Cl.
CPC ..... *E21B 43/122* (2013.01); *E21B 33/1208* (2013.01); *E21B 33/1294* (2013.01)

(58) Field of Classification Search
CPC ..... E21B 43/122; E21B 43/121
See application file for complete search history.

(56) References Cited

U.S. PATENT DOCUMENTS 2,309,383 A * 1/1943 Crites ..... F04F 1/18 417/147
3,090,316 A * 5/1963 Montgomery ..... E21B 43/122 166/372

(Continued)

FOREIGN PATENT DOCUMENTS

CN 2332812 Y 8/1999
CN 101787865 A 7/2010

(Continued)

OTHER PUBLICATIONS

International Search Report for Int'l Application No. PCT/CN2020/115564, titled: Permanent Packer and Extended Gas Lift Method Employing Permanent Packer, Date Mailed: Dec. 16, 2020 (English Translation Only).

(Continued)

*Primary Examiner* — Giovanna Wright
(74) *Attorney, Agent, or Firm* — Hamilton, Brook, Smith & Reynolds, P.C.

(57) ABSTRACT

The present invention discloses a permanent packer and an extended gas lift method using the permanent packer, the (Continued)

method comprising: S1. imbedding the extended gas lift embedded pipe when setting the permanent packer, wherein the extended gas lift embedded pipe has an upper end being closed and a lower end being open, is provided therein with a one-way valve through which the fluid can pass from top to bottom; S2. lowering a breaking device from the production casing when in the extended gas lift, to break the upper end of the extended gas lift embedded pipe such that the upper and lower ends of the extended gas lift embedded pipe are communicated; and S3. injecting gas into the production casing, lifting the accumulated liquid in the bottom hole to the ground surface, to complete the extended gas lift. The method does not affect the sealing property of the permanent packer, can fully adapt to the demand in the early and middle stages of gas well development, and meanwhile can realize extended gas lift without workover in the middle and later stages of gas well development, and has low implementation cost and good safety.

10 Claims, 7 Drawing Sheets

(56) References Cited

U.S. PATENT DOCUMENTS

| | | | |
|---|---|---|---|
| 4,258,787 | A | 3/1981 | Amancharia |
| 5,343,953 | A | 9/1994 | Patel et al. |
| 2009/0095467 | A1 | 4/2009 | Phoi-Montri et al. |
| 2015/0354325 | A1 | 12/2015 | Bolding et al. |

FOREIGN PATENT DOCUMENTS

| | | | |
|---|---|---|---|
| CN | 203822250 | U | 9/2014 |
| CN | 104847316 | A | 8/2015 |
| CN | 204571952 | U | 8/2015 |
| CN | 105672939 | A | 6/2016 |
| CN | 107605422 | A | 1/2018 |
| CN | 108131108 | A | 6/2018 |
| CN | 108166955 | A | 6/2018 |
| CN | 108222911 | A | 6/2018 |
| CN | 108252685 | A | 7/2018 |
| CN | 108457601 | A | 8/2018 |
| CN | 207686690 | U | 8/2018 |
| CN | 108999597 | A | 12/2018 |
| CN | 109083625 | A | 12/2018 |
| CN | 208473775 | U | 2/2019 |
| CN | 110608010 | A | 12/2019 |
| RU | 2 196 219 | C2 | 1/2003 |
| RU | 2 290 489 | C2 | 12/2006 |
| RU | 2 467 153 | C1 | 11/2012 |
| RU | 2 468 185 | C1 | 11/2012 |
| WO | WO 2009/099744 | A1 | 8/2009 |

OTHER PUBLICATIONS

*China Petroleum Machinery*, WEI ruiling, Application of Y341-114 Gas Lift Packer in Wendong Oilfield, vol. 31, No. 3, pp. 40-41 (Mar. 31, 2003) (Machine Translation Included).

Xiaolci, W. et al., "Rescarch on Nitrogen Gas Lift Cleanup in Xingjiang Oilfield," *Journal of Southwest Petroleum University* (*Science & Technology Edition*), vol. 36, No. 6, 6 pages (Dec. 2014) (English Abstract Included).

* cited by examiner

PERMANENT PACKER AND EXTENDED GAS LIFT METHOD USING PERMANENT PACKER

DECLARATION OF PRIORITY

This application is the U.S. National Stage of International Application No. PCT/CN2020/115564, filed on Sep. 16, 2020, which designates the U.S., published in Chinese, which claims the priorities of a Chinese patent for invention filed on Sep. 16, 2019 with the application number 201910871370.5, entitled "Permanent Packer and Extended Gas Lift Method using Permanent Packer" and a Chinese patent for invention filed on Sep. 16, 2019 with the application number 201910871364.X, entitled "Isolated Gas Lifting Water Draining and Gas Extraction Tube String". The teachings of the above applications are incorporated herein by reference in their entirety.

TECHNICAL FIELD

The present invention relates to a packer and an extended gas lift method using the packer, and more particularly, to a permanent packer and an extended gas lift method using the permanent packer.

BACKGROUND

In the process of oil and gas development, a gas well is usually used to exploit the oil and gas in an underground production layer. However, when the gas well is developed to the middle and late stage, the gas well bore and the formation near the bottom hole tend to accumulate liquid. When there is too much liquid accumulation or water production is too serious, the pressure of the liquid accumulation will cancel the pressure of the gas well, which will hinder the recovery of oil and gas. At this time, it is necessary to drain the gas well so that the gas well can resume normal production.

The existing drainage gas production processes are divided into mechanical processes and physical-chemical processes, among them, the mechanical processes include a pipe string drainage gas production process, a gas lift drainage gas production process, an electric submersible pump drainage gas production process, a mechanical drainage gas production process, while the physical-chemical processes are mostly foam drainage gas production processes. In the gas lift drainage gas production process, for example, high-pressure natural gas is injected from the surface into a gas well with stop blowout through a gas-lift pipe string, the energy of the gas is utilized to lift the liquid in the wellbore, thereby lifting the bottom hole liquid to the surface, to achieve the purpose of drainage gas production, and then the gas well can resume normal production.

However, for "three highs" gas wells with a high temperature, a high pressure and a high sulfur content, due to the above-mentioned particularity of the subsurface reservoir and the purpose of casing protection, a permanent packer is usually used for completion operation, and a production string with the permanent packer is used for natural gas recovery. In the gas lift drainage gas production process in the prior art, perforation on the packer is adopted, an oil jacket communication channel is established, and the oil pipe at a position above the perforation can be lifted to the surface through annular gas injection, and drainage gas production is realized, but only if the packer is close to the producing interval. For the packer position being far from the producing formation (for example, well Longgang 001-3), and the liquid level of the accumulated liquid is lower than the packer position, and perforating on the packer cannot meet the requirement of water drainage and gas production.

SUMMARY OF THE INVENTION

One of the purposes of the present invention is to provide a permanent packer and an extended gas lift method using the permanent packer for the above deficiencies, in order to solve the technical problems in the prior art such as not being able to meet the requirements for water drainage and gas production.

In order to solve the above technical problems, the invention adopt the following technical schemes:

The present invention provides a permanent packer, the body of the packer comprising a on/off collar, and the on/off collar is connected to a central pipe, the lower end of the central pipe is connected with a lower joint; and a lock sleeve, a lock spring, an upper slip, an upper cone, a packer rubber cylinder, a lower cone, a lower slip and a fixing ring are arranged outside the central pipe in an order from top to bottom.

The present invention provides an extended gas lift method using a permanent packer, the method comprising:

S1. imbedding the extended gas lift embedded pipe when setting the permanent packer, wherein the extended gas lift embedded pipe has an upper end being closed and a lower end being open, is provided therein with a one-way valve through which the fluid can pass from top to bottom, is located between a production oil pipe and a production casing, runs through a packing structure of the permanent packer and is in sealed connection to the packing structure;

S2: lowering a breaking device from the production casing when in the extended gas lift, to break the upper end of the extended gas lift embedded pipe so that the upper and lower ends of the extended gas lift embedded pipe are communicated;

S3: injecting gas into the production casing, lifting the accumulated liquid in the bottom hole to the ground surface, to complete the extended gas lift;

S4: after completion of the extended gas lift, injecting a curable fluid from the upper end of the extended gas lift embedded pipe to reinforce and block off the extended gas lift embedded pipe.

Compared with the prior art, one of the advantageous effects of the present invention is: in the invention, the extend gas lift method of the permanent packer is adopted, and the extended gas lift embedded pipe is pre-buried when the permanent packer is set, which does not affect the sealing property of the permanent packer, can fully adapt to the demand in the early and middle stages of gas well development, and meanwhile can realize extended gas lift without workover in the middle and later stages of gas well development, and has low implementation cost and good safety.

The permanent packer capable of completing extended gas lift provided by the invention has an ingenious structure and realizes two functions of permanent packing and extended gas lift on the basis of not changing the existing setting and sealing operation modes.

BRIEF DESCRIPTION OF THE DRAWINGS

As a part of the specification of the present invention, the following accompanying drawings illustrate exemplary embodiments of the present invention, and together with the description of the specification, serve to illustrate the principles of the invention.

Figure 1:
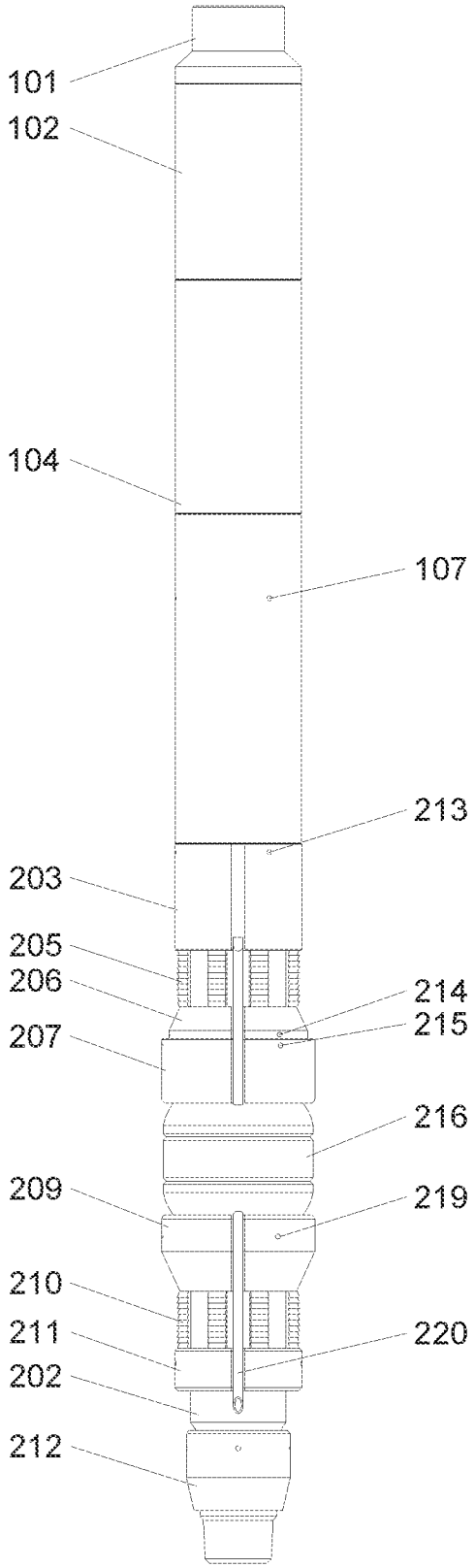
FIG. 1 is a structural schematic of a permanent packer of the present invention.

Description of the reference signs: 100 denotes a hydraulic setting device; 101 denotes an upper joint; 102 denotes an upper outer sleeve; 103 denotes an upper central pipe; 104 denotes an upper rubber cylinder holder; 105 denotes an elastic anti-collision ring; 106 denotes a piston; 107 denotes a starting shear pin; 108 denotes a piston supporting sleeve; 109 denotes a throw-off joint; 110 denotes an upper liquid inlet; 111 denotes a lower liquid inlet; 112 denotes a lower central pipe; 200 denotes a packer body; 201 denotes a on/off collar; 202 denotes a central pipe; 203 denotes a lock sleeve; 204 denotes a lock spring; 205 denotes an upper slip; 206 denotes an upper cone; 207 denotes a liquid storage chamber; 208 denotes a liquid injection pipe; 209 is a lower cone, 210 denotes a lower slip; 211 denotes a fixing ring; 212 denotes a lower joint; 213 denotes a setting shear nail; 214 denotes an upper cone shear nail; 215 denotes a liquid storage chamber shear nail; 216 denotes a packer rubber cylinder; 217 denotes an annular cavity; 218 denotes a support bar; 219 denotes a lower cone shear nail; 220 denotes an extended gas lift embedded pipe; 221 denotes a one-way valve; 222 denotes a fixing seat; 223 denotes a steel ball; and 224 denotes a support frame.

DETAILED DESCRIPTION OF THE PREFERRED EMBODIMENTS

In order to make objects, technical solution and advantages of the embodiment of the present invention clearer, the spirit of the present disclosure will be clearly illustrated by the accompanying drawings and detailed description, and after the embodiment of the present disclosure are understood by any persons skilled in the art, changes and modifications may be made to the technology taught by the present disclosure without departing from the spirit and scope of the present disclosure.

In order to make the technical solution and advantages of the present invention clearer, the embodiment of the present invention will be described in further detail with reference to the accompanying drawings.

Embodiments of the present invention provide an extended gas lift method using a permanent packer, the method comprising: a step a: imbedding the extended gas lift embedded pipe 220 when setting the permanent packer, wherein the extended gas lift embedded pipe 220 has an upper end being closed and a lower end being open, is provided therein with a one-way valve 221 through which the fluid can pass from top to bottom; the extended gas lift embedded pipe 220 is located between a production oil pipe and a production casing, runs through a packing structure of the permanent packer and is in sealed connection to the packing structure, the upper end of the extended gas lift embedded pipe 220 protrudes from an upper end of the packing structure, and the lower end of the extended gas lift embedded pipe 220 protrudes from a lower end of the packing structure; a step b: lowering a breaking device (the breaking device may be an existing perforator, a cutter, or the like capable of punching through the wall of the extended gas lift embedded pipe 220) from the production casing when in the extended gas lift, to break the upper end of the extended gas lift embedded pipe 220 such that the upper and lower ends of the extended gas lift embedded pipe 220 are communicated; a step c: injecting gas into the production casing, wherein the injected gas passes through the extended gas lift embedded pipe 220 into the underside of the packing structure, so as to lift the accumulated liquid in the bottom hole to the ground surface, and to complete the extended gas lift.

By means of the above technical scheme, in the extended gas lift method provided by the embodiments, the extended gas lift embedded pipe 220 is pre-buried when the permanent packer is set, the extended gas lift embedded pipe 220 is non-communicative before the destructive opening is made, this will not affect the sealing property of the permanent packer, and the performance is consistent with the performance of the existing permanent packer, and can completely adapt to the requirements of the early and middle stages of gas well development. In the middle and later stages of the development of a gas well, the formation near the well bore and bottom hole has too much accumulated liquid or serious water production, so it is necessary to drain the gas well for gas production. The upper end of the extended gas lift embedded pipe 220 is broken so that the upper and lower ends of the extended gas lift embedded pipe 220 can be communicated. The one-way valve 221 is provided which can prevent the high pressure below the packing structure from entering the upward side above the packing structure, which on the one hand, can ensure the safety of the operation of the step b, on the other hand, after the extended air lift drainage operation is finished, there is no need to keep the production casing continuously high pressure, which can not only reduce the production cost, but also reduce the equipment load and improve the safety. The production casing is pressurized, and when the pressure is greater than the pressure below the packing structure, the gas enters below the packing structure through the one-way valve 221 to lift the accumulated liquid from the production layer to the ground surface and realize extended gas lift.

It should be emphasized that the extended gas lift embedded pipe 220 is embedded in a manner besides penetrating from such a packing structure as the packer rubber cylinder 216 described below, the extended gas lift pre-embedded pipe 220 can be embedded in the wall of the central pipe 202 of the packer without affecting the mechanical properties of the packer, or such an extended gas lift passage can be opened in the wall of the central pipe 202, as long as the upper end of the extended gas lift channel is opened, the extended gas lift can be realized. There are various embodiments, and all other embodiments that are obtained by persons skilled in the art without making creative efforts shall fall within the protection scope of the present invention.

In the present embodiment, in order to seal the packer after completion of the extended gas lift, through the method, a curable fluid is injected from the upper end of the extended gas lift embedded pipe 220 after completion of the extended gas lift, and the extended gas lift embedded pipe 220 is reinforced and sealed. The curable fluid enters the extended gas lift embedded pipe 220, fills the one-way valve 221 and the pipe above it, and seals the extended gas lift embedded pipe 220 again after solidification, so as to prevent seal failure due to failure of the one-way valve 221. In specific operation, the curable fluid may be injected in at least two ways: one way is to lower a container containing the curable fluid, which is punctured above the extended gas lift embedded pipe 220 to allow the curable fluid to invade; in the alternative, the low-speed solidification fluid is directly injected from the upper end of the production casing and flows down to the packing structure by gravity, and then invades into the extended gas lift embedded pipe 220. To assist the curable fluid in entering the extended gas lift embedded pipe 220, a high pressure may be injected into the production casing and then reduced in pressure, enabling the curable fluid to fully encapsulate the one-way valve 221 for closed curing.

Figure 5:
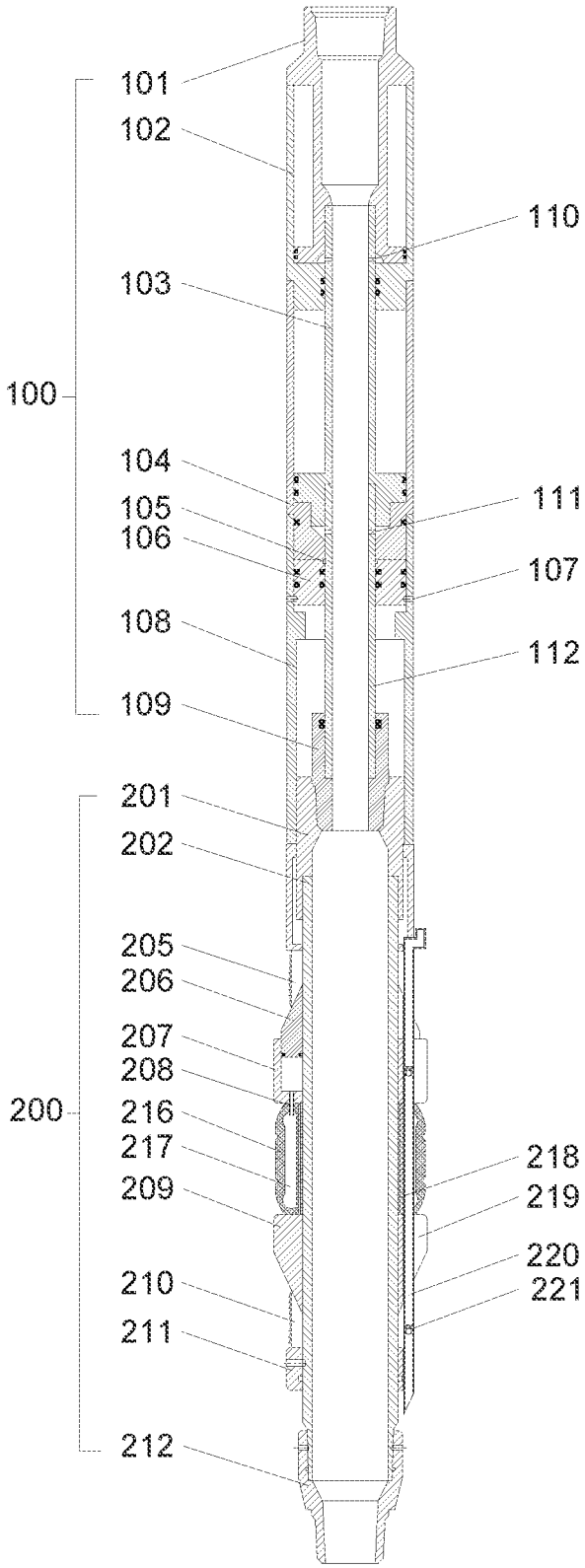
FIG. 5 is a structural schematic of the packer body.

As shown in FIG. 5, in order to conveniently destroy the upper end of the extended gas lift embedded pipe 220 by the breaking device, the upper end of the extended gas lift embedded pipe 220 is bent away from the permanent packer, and can reduce the chance of damaging the permanent packer by breaking the device.

Figure 7:
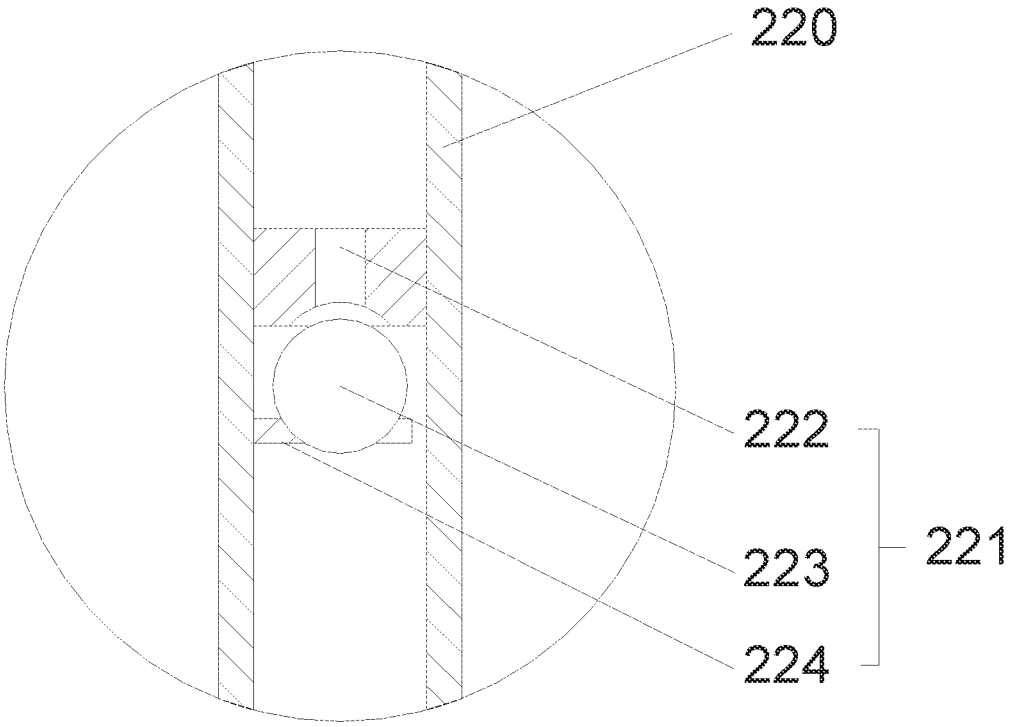
FIG. 7 is an enlarged view of part D of FIG. 5.

As shown in FIG. 7, specifically, in order to enable the one-way valve 221 to withstand high pressure, the one-way valve 221 may include a fixing seat 222, a steel ball 223 and a support frame 224, wherein the fixing seat 222 is provided with a through hole penetrating through the upper and lower surfaces thereof, the diameter of the through hole is smaller than that of the steel ball 223, which can ensure that the steel ball 223 is stuck in the through hole to block the through hole; the support frame 224 is located under the fixing seat 222, the support frame 224 and the fixing seat 222 are respectively fixedly connected to the inner wall of the extended gas lift embedded pipe 220; and the steel ball 223 can move between the support frame 224 and the fixing seat 222. In order to ensure the sensitivity of the one-way valve 221, when the steel ball 223 is positioned on the support frame 224, the distance between the steel ball 223 and the through hole of the fixing seat 222 should be as small as possible without affecting the downward flow of air.

In this embodiment, in order to increase the air-tightness of the one-way valve 221, the lower end of the through hole is provided with an arc-shaped groove adapted to the steel ball 223, which is in surface contact with the steel ball 223, and the air-tightness is better, and in addition, the deformation and failure probability of the through hole of the fixing seat 222 can be reduced.

In the present embodiment, the one-way valve 221 cannot be activated because the steel ball 223 is prevented from being lifted due to too small differential pressure. A compression spring is disposed between the steel ball 223 and the support frame 224, and the compression spring presses the steel ball 223 into the arc-shaped groove of the fixing seat 222. Even if the pressure difference across the one-way valve 221 is zero, the one-way valve 221 is in a closed state, and it is possible to completely prevent the downward gas from going up.

In the present embodiment, a plurality of one-way valves 221 may be provided in the extended gas lift embedded pipe 220, so that multiple protection can be performed, and the reliability of the extended gas lift embedded pipe 220 can be improved.

Referring to FIG. 5, the present invention also provides a permanent packer comprising a packer body 200 including a on/off collar 201 capable of being connected to the hydraulic setting device 100, the on/off collar 201 is connected to a central pipe 202, the lower end of the central pipe 202 is connected with a lower joint 212; a lock sleeve 203, a lock spring 204, an upper slip 205, an upper cone 206, a packer rubber cylinder 216, a lower cone 209, a lower slip 210 and a fixing ring 211 are arranged outside the central pipe 202 in an order from top to bottom, and further comprising the extended gas lift embedded pipe 220 adopted in the above scheme, wherein the extended gas lift embedded pipe 220 has an upper end being closed and a lower end being open, is provided therein with a one-way valve 221 through which the fluid can pass from top to bottom; the extended gas lift embedded pipe 220 passes through the packer rubber cylinder 216, and the extended gas lift embedded pipe 220 is fixedly connected to the packer rubber cylinder 216.

Figure 3:
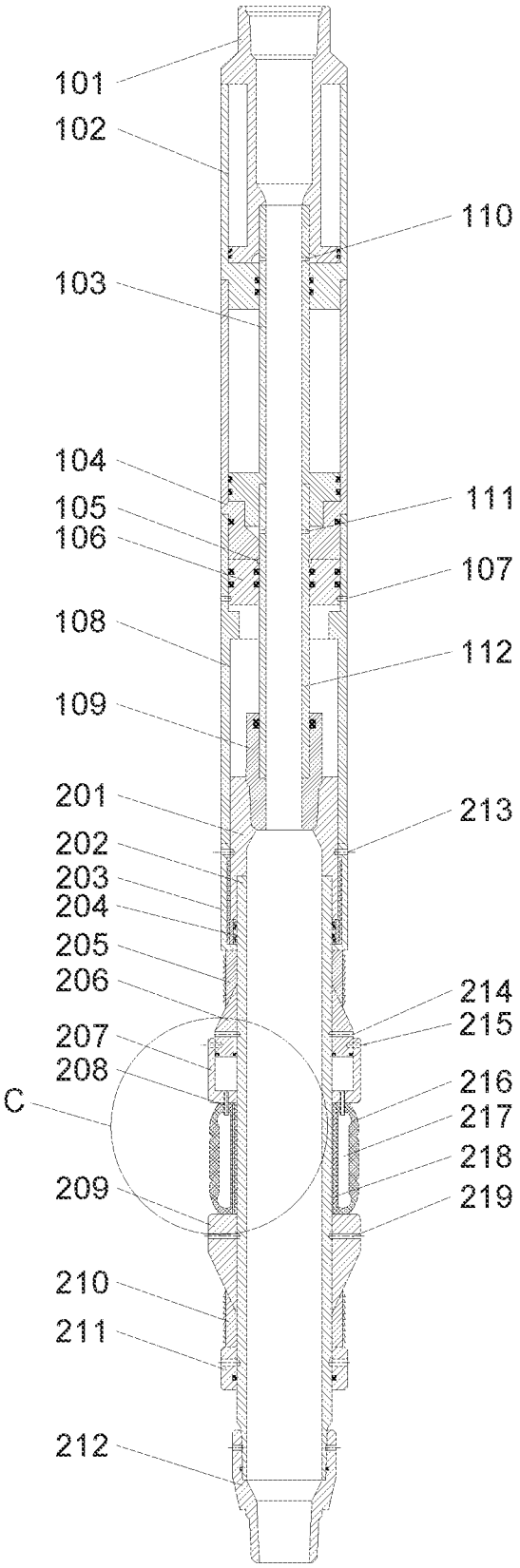
FIG. 3 is an A-A sectional view of FIG. 2.

By means of the above technical scheme, the permanent packer provided by this embodiment follows the working principle as below: the on/off collar 201 is used to upward connect the hydraulic setting device 100, and the lower joint 212 is used to connect the oil pipe and the special setting ball seat, after being lowered to the predetermined position, a steel ball is put into the special setting ball seat from the production tubing of the wellhead, and the hydraulic setting device 100 is pressurized from the oil pipe, and the downward thrust is transmitted to the lock sleeve 203 of the packer body 200 under the action of external pressure. The lock sleeve 203 moves downward to shear the setting shear nail 213 on the lock sleeve 203, pushes the upper slip 205 to shear the upper cone shear nail 214 on the upper cone 206 and the lower cone shear nail 219 on the lower cone 209, such that the upper and lower slips 205 and 210 are anchored, and the packer sets the card. It is possible to slowly continue to accumulate pressure, so that the upper and lower slips 205 and 210 are anchored and the packer rubber cylinder 216 is set firmly. (This technical solution is not shown in the drawings, and referring to FIGS. 1, 3 and 4, it is the solution described above that the upper cone 206 and the liquid storage chamber 207 are considered as one.) The lock sleeve 203, the lock spring 204 and the central pipe 202 will firmly lock the moving parts, and the permanent packer will not be moved. The pressure is increased to drive the steel ball on the setting ball seat into the bottom hole, adjust the pipe string to the position of the setting tool at the stress neutral point, ensure that the pressure in the drill pipe has been relieved, and rotate the hydraulic setting device to the right. The throw-off joint 109 is driven to rotate the square thread to release the hydraulic setting device 100, so that the hydraulic setting device 100 is separated from the packer body 200, and then the pipe string is lifted to realize throw-off. Production can be started after installation of production oil pipe continues. The breaking device is lowered from the production casing when in the extended gas lift, to break the upper end of the extended gas lift embedded pipe 220 such that the upper and lower ends of the extended gas lift embedded pipe 220 are communicated. Then gas is injected into the production casing, wherein the injected gas passes through the extended gas lift embedded pipe 220 into the underside of the packing structure, so as to lift the accumulated liquid in the bottom hole to the ground surface.

Figure 2:
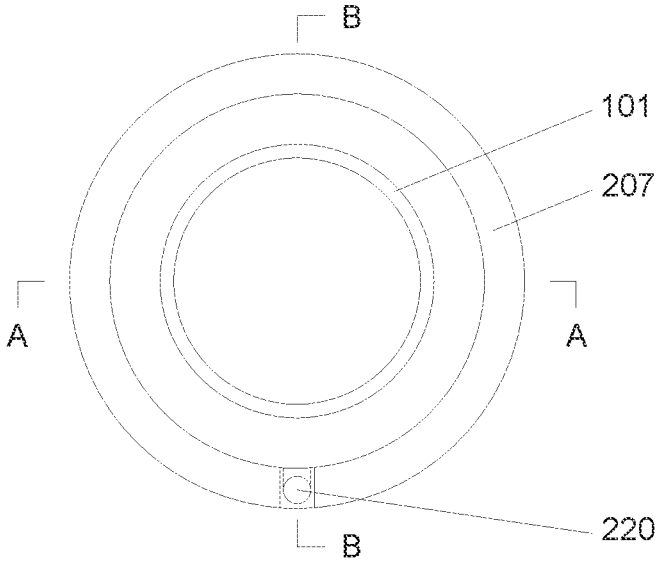
FIG. 2 is a top view of FIG. 1.
Figure 4:
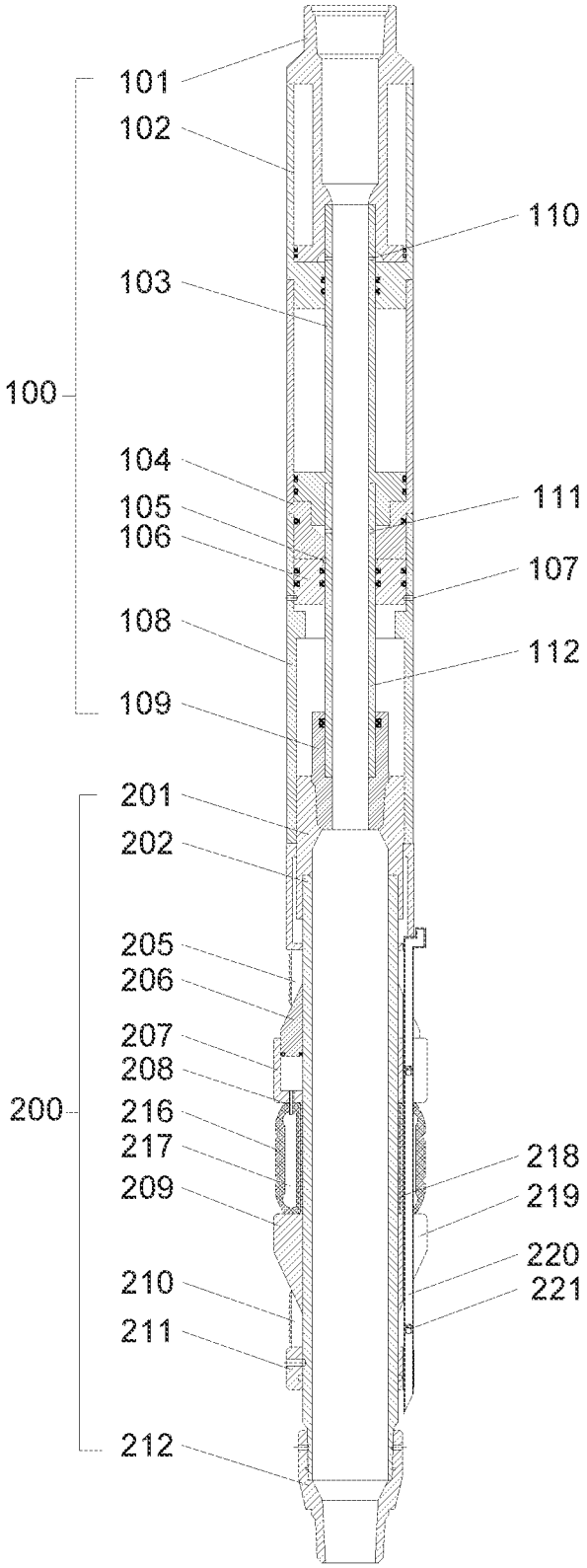
FIG. 4 is a B-B sectional view of FIG. 2.

Specifically, as shown in FIG. 1, FIG. 2 and FIG. 4, the side surfaces of the lock sleeve 203, the upper cone 206, the lower cone 209 and the fixing ring 211 are respectively provided with an escape groove for avoiding the extended gas lift embedded pipe 220, such that the extended gas lift embedded pipe 220 does not protrude from the outer contour of the packer body 200, avoiding damage due to collision during installation and tripping.

Figure 6:
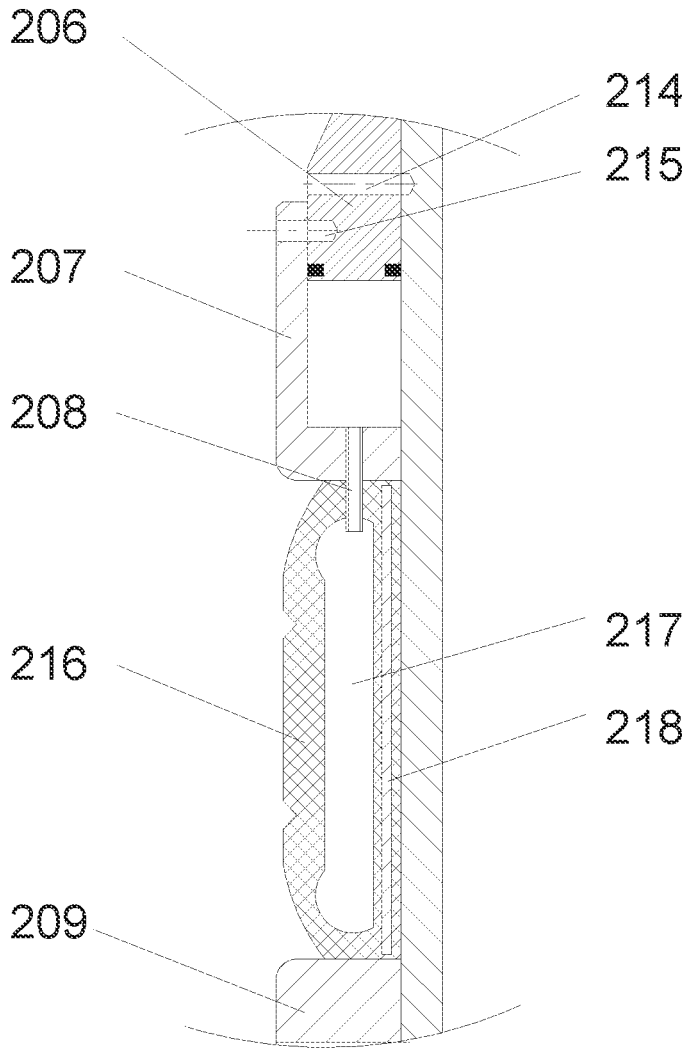
FIG. 6 is an enlarged view of part C of FIG. 3.

In the present embodiment, as shown in FIG. 6, in order to prevent the sealing property between the packer rubber cylinder 216 and the extended gas lift embedded pipe 220 from being affected during the compression deformation of the packer rubber cylinder 216, an annular cavity 217 is provided in the packer rubber cylinder 216, and the annular cavity 217 is filled with a first curable component. A liquid storage chamber 207 is provided between the packer rubber cylinder 216 and the upper cone 206 or the lower cone 209, and the liquid storage chamber 207 communicates with the annular cavity 217 through the liquid injection pipe 208, and the liquid storage chamber 207 is filled with a second curable component. The extended gas lift embedded pipe 220 passes through the annular cavity 217. After the liquid storage chamber shear nail 215 are sheared by pressure, the upper cone 206 can be pressed into the liquid storage chamber 207 to press the second curable component into the annular cavity 217 to be mixed with the first curable component. The annular cavity 217 receives the pressed-in second curable component and increases in volume such that the packer rubber cylinder 216 bulges outwardly to set. After the first curable component and the second curable component are mixed and cured, the packer rubber cylinder 216 cannot be deformed, so as to form a permanent set, resulting in higher stability. On the other hand, the extended gas lift embedded pipe 220 passes through the annular cavity 217, and the sealing property between the packer rubber cylinder 216 and the extended gas lift embedded pipe 220 can be ensured by curing and sealing.

In the present embodiment, in order to prevent the first curable component and the second curable component from being mixed and cured before setting, a separation film (not shown) is provided in the liquid injection pipe 208, which is damaged when being subjected to a strong pressure from the liquid storage chamber 207, thereby allowing the second curable component to enter the annular cavity 217.

In the present embodiment, in order to prevent the axial deformation of the packer rubber cylinder 216, the packer rubber cylinder 216 is embedded with a support bar 218 which is between the annular cavity 217 and the central pipe 202, to prevent the support bar 218 from affecting the outward bulging of the packer rubber cylinder 216. Specifically, there are several support bars 218, and all of the support bars 218 are evenly distributed along the circumference of the packer rubber cylinder 216.

In this embodiment, the upper slip 205 and the lower slip 210 are C-shaped slips with an axial opening, which increases the elastic deformation ability of the slips, so that the slips are easy to expand and set and not easy to be broken and damaged. Thus the first success rate of downhole installation of packer is effectively improved, and the installation efficiency of packer is improved.

In the present embodiment, the inner holes of the upper slips 205 and the lower slips 210 are provided therein with damping internal threads, and the outer circumference of the central pipe 202 is provided with external threads adapted to the damping internal threads to prevent the packer from rising and sliding down, which overcomes the past problem of setting the permanent packer in advance in the process of tripping in well, avoids the accident in the process of tripping in, reduces the construction difficulty, and further improves the construction efficiency and the success rate.

Specifically, the inner serration thread arranged in the inner hole of the lock sleeve 203 is engaged with the outer serration thread arranged outside the lock spring 204 to form a step-by-step locking mechanism. The lock sleeve 203 of the step-by-step locking mechanism is provided with a setting shear nail 213, and an inner end tip of the setting shear nail 213 extends out of the lock sleeve 203 to match with the corresponding pin hole of the on/off collar 201.

In this embodiment, as shown in FIG. 1, FIG. 2, FIG. 3, and FIG. 4, in order to facilitate setting, a hydraulic setting device 100 used in cooperation with the packer body 200 may be further included. The hydraulic setting device 100 may include an upper joint 101 and an upper outer sleeve 102, and the lower end of the upper joint 101 is connected to an upper central pipe 103, thereby forming an upper hydraulic chamber. The upper central pipe 103 has a lateral upper fluid inlet hole 110 communicating with the upper hydraulic chamber, the lower end of the upper outer sleeve 102 is connected to the upper rubber cylinder holder 104, the lower end of the upper rubber cylinder holder 104 is connected to the piston supporting sleeve 108, and the lower end of the upper central pipe 103 is connected to the lower central pipe 112. The upper end of the annular cavity between the piston supporting sleeve 108 and the lower central pipe 112 is installed with the piston 106 to closely adjoin the lower end of the upper rubber cylinder holder 104 to form a lower hydraulic chamber, and the lower central pipe 112 has a lower liquid inlet hole 111 which communicates with the lower hydraulic chamber. The lower end of the lower central pipe 112 is connected to the throw-off joint 109 which mates with the on/off collar 201. When the pressure is applied, the upper fluid inlet hole 110 and the lower fluid inlet hole 111 are simultaneously filled with pressure to expand the upper hydraulic chamber and the lower hydraulic chamber, thereby increasing the downward thrust.

In the present embodiment, an elastic anti-collision ring 105 is installed at the upper end of the inner hole of the piston 106 of the lower hydraulic chamber, and an inner ring of the elastic anti-collision ring 105 is engaged with an annular groove of the lower center pipe 112. The outer periphery of the piston 106 is provided with a starting shear pin 107 through a piston supporting sleeve 108 to form an anti-seating and blocking device, thereby improving the success rate of going into the well.

Any numerical value referred to herein includes all values of a lower value and an upper value that are incremented by one unit from a lower limit value to an upper limit value, with an interval of at least two units between any lower value and any higher value. For example, if it is stated that the number of components or process variables such as temperature, pressure, time, etc., have a value from 1 to 90, preferably from 20 to 80, more preferably from 30 to 70, the purpose is to illustrate that the equivalents such as 15 to 85, 22 to 68, 43 to 51, 30 to 32 are also explicitly recited in the specification. For values smaller than 1, one unit is suitably considered to be 0.0001, 0.001, 0.01, 0.1. These are merely intended to be explicitly expressed examples, and it may be considered that all possible combinations of numerical values enumerated between the lowest value and the highest value are explicitly set forth in a similar manner in this specification.

Unless otherwise stated, all ranges include end points and all numbers between the end points. The "about" or "approximate" used with the range is suitable for both end points of the range. Thus, "about 20 to 30" is intended to cover "about 20 to about 30," including at least the indicated end points.

In addition to the above, it should be noted that "one embodiment," "another embodiment," "embodiments" and the like, which are mentioned in this specification, refer to that a particular feature, structure, or characteristic described in connection with the embodiment are included in at least one of the embodiments generally described herein. The appearance of the same expression in multiple places in the specification does not necessarily refer to the same embodiment. Further, when a particular feature, structure, or characteristic is described in connection with any of the embodiments, it is intended that such feature, structure, or characteristic implemented in connection with other embodiments shall also falls within the scope of the present invention.

Although the present invention has been described herein with reference to a number of illustrative embodiments thereof, it should be understood that many other modifications and implementations may be devised by those skilled in the art, and these modifications and embodiments are intended to fall within the scope and spirit of the principles disclosed in this application. More particularly, various variations and improvements may be made to the component parts and/or arrangements of the subject combination layout within the scope of the present disclosure, drawings and claims. In addition to variations and improvements of the component parts and/or arrangements, other uses will be apparent to those skilled in the art.

The invention claimed is:

1. A permanent packer, characterized in that, the packer comprises a packer body and extended gas lift embedded pipe, wherein the extended gas lift embedded pipe has an upper end being closed and a lower end being open, is provided therein with a one-way valve through which the fluid can pass from top to bottom; the extended gas lift embedded pipe runs through a packer rubber cylinder of the packer body up and down, and is fixedly connected to the packer rubber cylinder.

2. The permanent packer according to claim 1, characterized in that, the packer body includes a on/off collar, and the on/off collar is downward connected to a central pipe, and a lower end of the central pipe is connected with a lower joint; a lock sleeve, a lock spring, an upper slip, an upper cone, a packer rubber cylinder, a lower cone, a lower slip and a fixing ring are arranged outside the central pipe in an order from top to bottom.

3. The permanent packer according to claim 1, characterized in that, an annular cavity is provided in the packer rubber cylinder, and the annular cavity is filled with a first curable component; a liquid storage chamber is provided between the packer rubber cylinder and an upper cone or a lower cone, and the liquid storage chamber is filled with a second curable component, and the liquid storage chamber communicates with the annular cavity through a liquid injection pipe, and a separation film is provided in the liquid injection pipe, and the extended gas lift embedded pipe passes through the annular cavity.

4. The permanent packer according to claim 3, characterized in that, the packer rubber cylinder is embedded with a support bar which is between the annular cavity and a central pipe; there are several support bars, and all of the support bars are evenly distributed along the circumference of the packer rubber cylinder.

5. The permanent packer according to claim 4, characterized in that, an upper slip and a lower slip are C-shaped slips with an axial opening; inner holes of the upper slips and the lower slips are provided therein with damping internal threads, and the outer circumference of the central pipe is provided with external threads adapted to the damping internal threads.

6. The permanent packer according to claim 5, characterized in that, an inner serration thread arranged in an inner hole of a lock sleeve is engaged with an outer serration thread arranged outside a lock spring; the lock sleeve is provided with a setting shear nail, and an inner end tip of the setting shear nail extends out of the lock sleeve to match with a corresponding pin hole of an on/off collar.

7. The permanent packer according to claim 5, characterized in that, the permanent packer further comprises a hydraulic setting device, the hydraulic setting device includes an upper joint and an upper outer sleeve, and a lower end of the upper joint is connected to an upper central pipe, thereby forming an upper hydraulic chamber; the upper central pipe has a lateral upper fluid inlet hole communicating with the upper hydraulic chamber, a lower end of the upper outer sleeve is connected to an upper rubber cylinder holder, a lower end of the upper rubber cylinder holder is connected to a piston supporting sleeve, and a lower end of the upper central pipe is connected to a lower central pipe, an upper end of the annular cavity between the piston supporting sleeve and the lower central pipe is installed with the piston to closely adjoin the lower end of the upper rubber cylinder holder to form a lower hydraulic chamber, and the lower central pipe has a lower liquid inlet hole which communicates with the lower hydraulic chamber; a lower end of the lower central pipe is connected to a throw-off joint which mates with an on/off collar; an elastic anti-collision ring is installed at an upper end of an inner hole of the piston, an inner ring of the elastic anti-collision ring is engaged with an annular groove of the lower center pipe, and the outer periphery of the piston is provided with a starting shear pin through the piston supporting sleeve.

8. An extended gas lift method using a permanent packer according to claim 1, characterized in that, the method comprises:

S1: imbedding the extended gas lift embedded pipe when setting the permanent packer, wherein the extended gas lift embedded pipe has an upper end being closed and a lower end being open, is provided therein with a one-way valve through which fluid can pass from top to bottom, is located between a production oil pipe and a production casing, runs through a packing structure of the permanent packer and is in sealed connection to the packing structure;

S2: lowering a breaking device from the production casing when in the extended gas lift, to break the upper end of the extended gas lift embedded pipe such that the upper and lower ends of the extended gas lift embedded pipe are communicated;

S3: injecting gas into the production casing, lifting the accumulated liquid in a bottom hole to a ground surface, to complete the extended gas lift;

S4: after completion of the extended gas lift, injecting a curable fluid from the upper end of the extended gas lift embedded pipe to reinforce and block off the extended gas lift embedded pipe.

9. The extended gas lift method using a permanent packer according to claim 8, characterized in that, the upper end of the extended gas lift embedded pipe is bent away from the permanent packer; the one-way valve includes a fixing seat, a steel ball and a support frame, wherein the fixing seat is provided with a through hole penetrating through upper and lower surfaces thereof, the diameter of the through hole is smaller than that of the steel ball, the lower end of the through hole is provided with an arc-shaped groove adapted to the steel ball; a compression spring is disposed between the steel ball and the support frame, and the compression spring presses the steel ball into the arc-shaped groove of the fixing seat; the support frame is located under the fixing seat, the support frame and the fixing seat are respectively fixedly connected to the inner wall of the extended gas lift embedded pipe; and the steel ball can move between the support frame and the fixing seat.

10. The extended gas lift method using a permanent packer according to claim 9, characterized in that, the extended gas lift embedded pipe is provided therein with a plurality of one-way valves.

* * * * *